US012679580B2

(12) United States Patent
Grassi

(10) Patent No.: US 12,679,580 B2
(45) Date of Patent: Jul. 14, 2026

(54) WRAPPING MACHINE FOR WRAPPING A PALLETIZED LOAD

(71) Applicant: ERCOPAC S.R.L., Scandiano (IT)

(72) Inventor: Antonio Grassi, Scandiano (IT)

(73) Assignee: ERCOPAC S.R.L., Scandiano (IT)

( * ) Notice: Subject to any disclaimer, the term of this patent is extended or adjusted under 35 U.S.C. 154(b) by 0 days.

(21) Appl. No.: 18/640,069

(22) Filed: Apr. 19, 2024

(65) Prior Publication Data

US 2024/0425213 A1 Dec. 26, 2024

(30) Foreign Application Priority Data

Apr. 20, 2023 (IT) ..... 102023000007818

(51) Int. Cl.
*B65B 51/10* (2006.01)
*B65B 11/04* (2006.01)
*B65B 61/06* (2006.01)

(52) U.S. Cl.
CPC ..... *B65B 11/045* (2013.01); *B65B 51/10* (2013.01); *B65B 61/06* (2013.01)

(58) Field of Classification Search
USPC ..... 53/203
See application file for complete search history.

(56) References Cited

U.S. PATENT DOCUMENTS

2014/0013707 A1* 1/2014 Murarotto ..... B65B 11/045 53/203
2022/0169407 A1* 6/2022 Magri ..... B65B 11/045
2022/0355958 A1* 11/2022 Magri ..... B65B 61/06
2022/0371758 A1* 11/2022 Magri ..... B65B 61/06

FOREIGN PATENT DOCUMENTS

CN 112441268 A 3/2021
EP 0597809 A1 5/1994
EP 4008638 A1 6/2022

OTHER PUBLICATIONS

Search Report Dated Jan. 10, 2024 From Priority Italian Application IT2023000007818.

* cited by examiner

*Primary Examiner* — Chinyere J Rushing-Tucker
(74) *Attorney, Agent, or Firm* — Carmel Patent Agency; Robert Ballarini

(57) ABSTRACT

A wrapping machine for wrapping a palletized load, by means of a stretch film protective wrapping material, and a support pallet on which a plurality of products are stacked, the machine includes: support means for supporting the palletized load configured to hold it and/or shift it into an operating position for wrapping and to make said palletized load rotate according to an axis of vertical symmetry; a winding head configured to support and unwind a coil of film; a lifting body having a bearing structure extending vertically. The lifting body includes a shifting apparatus vertically movable along said bearing structure and adapted to support and shift in a horizontal direction the winding head, when moving closer to/away from the support means and/or from the palletized load.

9 Claims, 9 Drawing Sheets

WRAPPING MACHINE FOR WRAPPING A PALLETIZED LOAD

CROSS-REFERENCE TO RELATED APPLICATIONS

This application claims priority of Italian Patent Application number IT102023000007818, filed Apr. 20, 2023, the contents of which are incorporated by reference herein as if fully set forth.

FIELD OF APPLICATION OF THE INVENTION

This invention fits into the field of wrapping machines for wrapping palletized loads, in particular by means of stretch film.

STATE OF THE ART

Automatic wrapping machines for packaging and stabilizing palletized loads, i.e. the articles generally stacked on loading pallets, but also for example on flaps, pallets with wheels, etc. are known in the state of the art.

This allows the containment, the stabilization, the protection and the waterproofing of the load, preserving its integrity and facilitating the transport and storage of the articles.

The known wrapping machines can be of various types, for example with rotating arm and fixed palletized load or with fixed arm and rotating palletized load, or of another type.

The wrapping machines generally use stretch-type films to protect all or part of the vertical surface of the load.

The wrapping by means of stretch film typically covers the four vertical sides of the load with a stretch packaging material such as polyethylene film. In order to carry out the wrapping of the palletized load, a relative rotation is provided between the load and a dispenser of packaging material for wrapping said packaging material around the sides of the load.

The concerned wrapping machine falls within the field of machines that carry out the wrapping by rotating the palletized load, while the film dispenser is not rotatable.

When a complete protection of the load is required, these wrapping machines can be combined with apparatuses that apply cover sheets to the top of the palletized loads to be wrapped, so as to preserve them from external agents such as water or dust that could otherwise deposit and/or penetrate inside.

Furthermore, depending on the type of wrapping of the palletized load that can be of the anti-dust or waterproof type, the film is wound around the load in different ways.

In fact, a known anti-dust type winding mode involves firstly, the application of the cover film on the top of the palletized load, and then the winding of the film on the side surface of the entire load, in particular starting from the top and then descending towards the base.

On the contrary, an anti-water winding mode, provides that the film is wound starting from the base of the load and then rising up to the top, and subsequently the cover film can be applied/deposited.

In fact, immediately after the possible application of the cover sheet, said load reaches the wrapping position inside the wrapping machine and, on top of the same load, a presser is positioned integral with the load, which stabilizes the palletized load during wrapping.

Subsequently, the film dispenser generally comprising a winding head, which supports a film coil suitable for wrapping the load sideways, is placed next to the load itself; the relative rotation between the winding head and the load causes the film, suitably pre-stretched, to be wound around the load as desired.

The amount of pre-stretch applied to the film and the winding force applied to the load during the winding or wrapping of the load causes the containment force of the palletized load.

In machines of the known type, the wrapping machine generally comprises a gantry or column structure, capable of operating over the entire side surface of the palletized load, and support means of the palletized load configured to hold it and/or bring it into operating position for wrapping and capable of rotating said palletized load during wrapping.

In said machines, since it is the palletized load that rotates, the winding head that supports the coil is not rotatable and is only movable in a vertical direction.

Therefore, in all these types of machines, one disadvantage is that the distance between the coil and the load is always large, as these machines must be able to handle palletized loads with very different dimensions, e.g. 400×600, 800×1200, 100×1200, 1420×1120, etc., which are generally standard dimensions of a support pallet. Furthermore, the distance between the coil and the load can be increased by the fact that the coil is positioned outside the rotating footprint of the means supporting the palletized load.

This large distance is mainly due to the fact that, in order to work in mechanical safety, the work cycle provides that the winding head supporting the coil is held in a position that is distant not only from the palletized load, but also distant from the load support means.

In fact, generally the winding head and the pallet support means have footprints that do not allow to bring said coil closer to the load.

Generally, the support means have upward projections that can interfere with the winding head. Conversely, also the winding head generally comprises downward projecting elements that can interfere with the support means.

Said winding head, therefore, in order to be able to operate safely by means of a relative rotation with the load, must be maintained on a greater circumference than the one which is circumscribed not only by the load, but also by the support means.

The large distance between the coil and the load leads to an increase in the machine cycle time, affecting its production rate.

Particularly in the initial step and final step of the wrapping cycle, it is necessary to perform maneuvers that burden on the cycle time.

In particular when, in the initial step, the palletized load is brought into the wrapping position, it is necessary to take an initial flap of film, making it integral with the palletized load.

Therefore, a cycle of bringing closer the holding means, which must take the film from the coil and hold it during the wrapping cycle, is carried out.

As the coil is distant from the load, the round-trip shift of the holding means towards the coil, is time-consuming, resulting in a long shift time.

The cycle time is also affected when, in the final step, it is necessary to cut and clamp the final flap of the film making it integral with the palletized load.

In this case, the known machines must perform a cycle to move the palletized load closer to the coil. This cycle involves rotating the load support means so as to advance said load towards the coil and once the cutting and clamping operation of the end flap has been carried out, provides moving the load away by returning it to its previous position and rotating the support means to allow it to be evacuated.

The time to perform said cycle is clearly long.

An alternative solution to machines with a gantry or column structure, which have these drawbacks, is a machine wherein an additional component, independent of the winding head, is present, for example a rotating or shifting arm on which means are installed to cut and clamp the film. However, this involves a greater complexity of the machine.

A further alternative is a machine made from an anthropomorphic robot.

In this case, the film-winding head is installed on the wrist of the anthropomorphic robot.

The operating flexibility of an anthropomorphic robot makes it possible to reduce the aforesaid cycle times. In fact, in the initial step, it is possible to bring the winding head and thus the coil closer to the holding means; in the final step, it is possible to clamp the final flap of the film by moving the winding head closer to the palletized load without having to move the load or rotate the support means.

The disadvantage of this solution is that the anthropomorphic robot has high purchase costs and requires high-level programming skills.

A further disadvantage of the known gantry or column machines is that in them it is complex to perform certain maintenance or format change operations such as changing the winding head. The winding head is in fact positioned between the machine structure and the support means, i.e. in an area cluttered with components and difficult to access.

SUMMARY

The technical problem underlying the present invention is that of making available a wrapping machine for a palletized load functionally designed to overcome one or more of the limits set forth above with reference to the aforesaid prior art.

In the context of the aforesaid problem, a main object of the invention is to develop a wrapping machine that enables a solution reducing the cycle time for wrapping the palletized load, thus improving the machine production rate.

It is also the object of the invention to make available to the art a wrapping machine that facilitates maintenance operations as well as winding-head change and coil change operations.

A further object of the invention is also to make available to the art a wrapping machine that allows the same working recipes to be used on an anthropomorphic robot, enabling the standardization of programs for different types of pallet or film.

These and other objects are reached by the characteristics of the invention as set forth in the independent claims. The dependent claims outline preferred and/or particularly advantageous aspects of the invention.

In particular, the present invention makes available a machine for wrapping a palletized load by means of a protective packaging material in particular a stretch film, said palletized load comprising a support pallet on which a plurality of products are stacked.

Said machine preferably comprises means for supporting the palletized load configured to hold it and/or shift it into a wrapping operating position and to rotate said palletized load according to a vertical axis of symmetry.

This machine preferably comprises a winding head configured to support and unwind a coil of film.

Said machine preferably comprises a lifting body comprising a bearing structure that extends vertically.

Preferably said lifting body comprises a shifting apparatus that is vertically movable along said bearing structure.

Preferably, said shifting apparatus is adapted to support and shift the winding head in a horizontal direction, moving closer to/away from the support means and/or the palletized load.

Preferably, the shifting apparatus is vertically movable along said bearing structure, in order to vertically shift the winding head and wrap the palletized load over a part or over its entire height, in particular during the rotation of said palletized load.

Preferably the shifting apparatus comprises a beam and a horizontally movable carriage interposed between the beam and the winding head.

Preferably the winding head is removably installed on the carriage.

Preferably, the shifting apparatus is configured to shift the winding head in the direction away from the support means to a position wherein the winding head co-operates with receiving means adapted to carry out the change of the winding head.

Preferably, the carriage comprises rotation means, configured to rotate said winding head around a vertical axis and preferably moving away from the shifting apparatus and/or the bearing structure, in order to position it on the receiving means.

Preferably the machine comprises holding means configured to take an initial flap of film from the coil and hold it during wrapping, said holding means being preferably positioned at the top or at the base of the palletized load to be wrapped.

Preferably, the shifting apparatus shifts the winding head in a horizontal direction to bring it closer to the holding means.

Preferably, the holding means are configured to shift closer to the winding head.

Preferably the winding head comprises cutting means and/or adhesion means to cut the final film flap and preferably clamp it by making it integral with the wrapped palletized load.

Preferably, the adhesion means may comprise welding elements and/or pressure elements.

Said objects and advantages are all achieved by the wrapping machine, object of the present invention, configured for wrapping a palletized load by means of a protective packaging material, which is characterized as provided in the claims below.

BRIEF DESCRIPTION OF THE DRAWINGS

These and other features will be more apparent from the following description of certain embodiments illustrated by way of non-limiting example in the accompanying drawings.

DETAILED DESCRIPTION OF THE PREFERRED EMBODIMENTS

Figure 1:
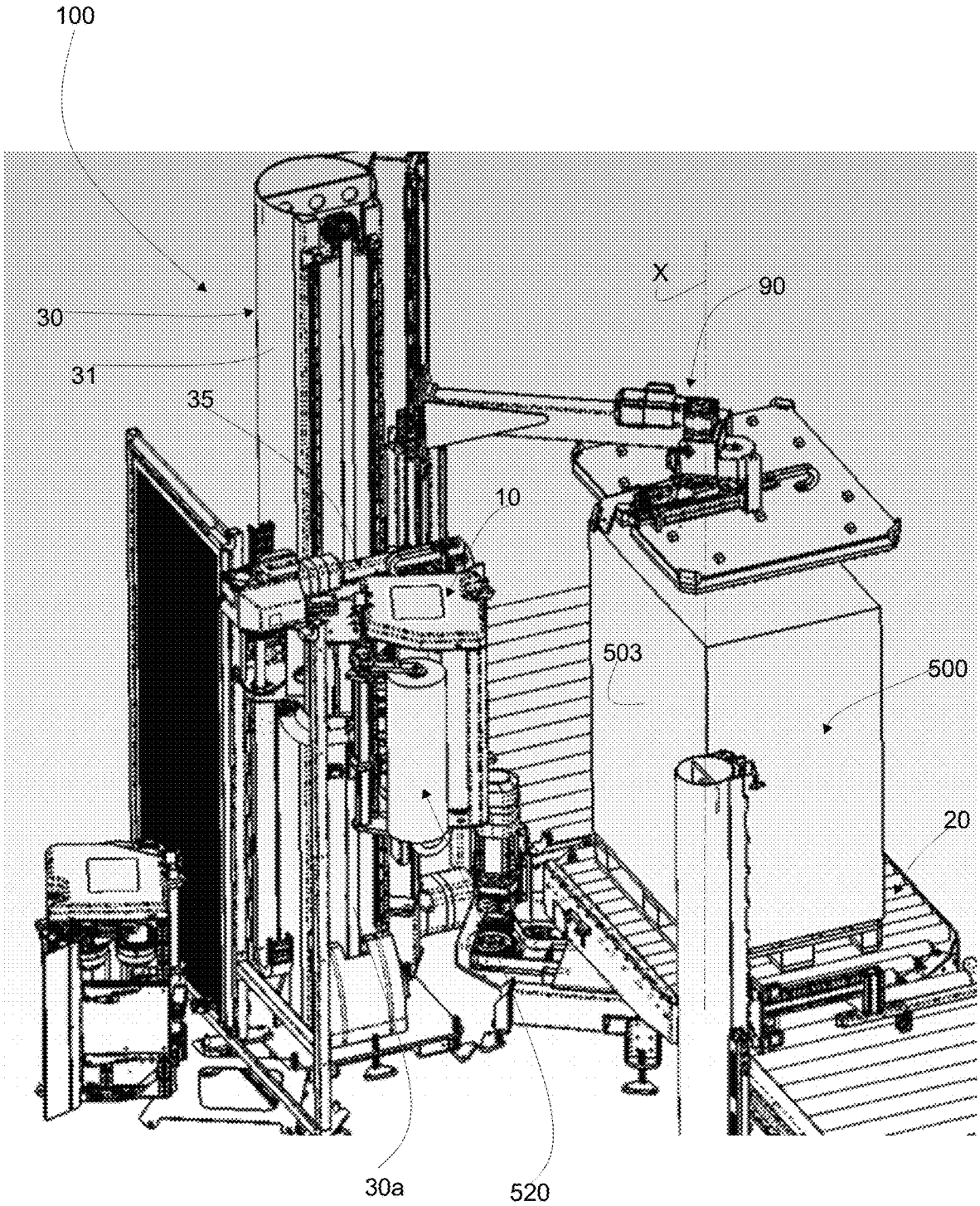
FIG. 1: illustrates an axonometric view of a wrapping machine.
Figure 2:
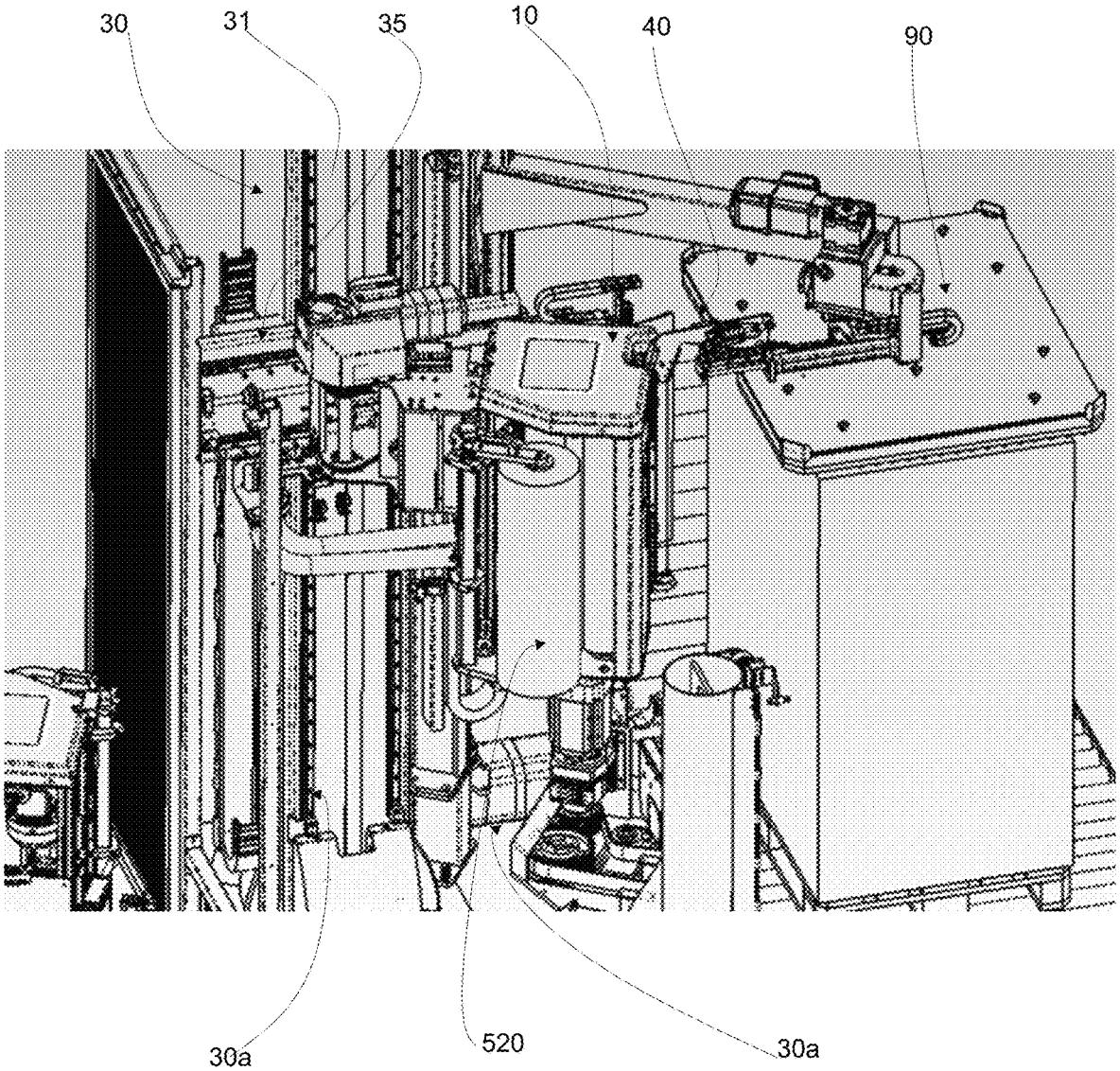
FIG. 2: illustrates an axonometric view of a wrapping machine in the operating position of taking the initial flap of the film.
Figure 3:
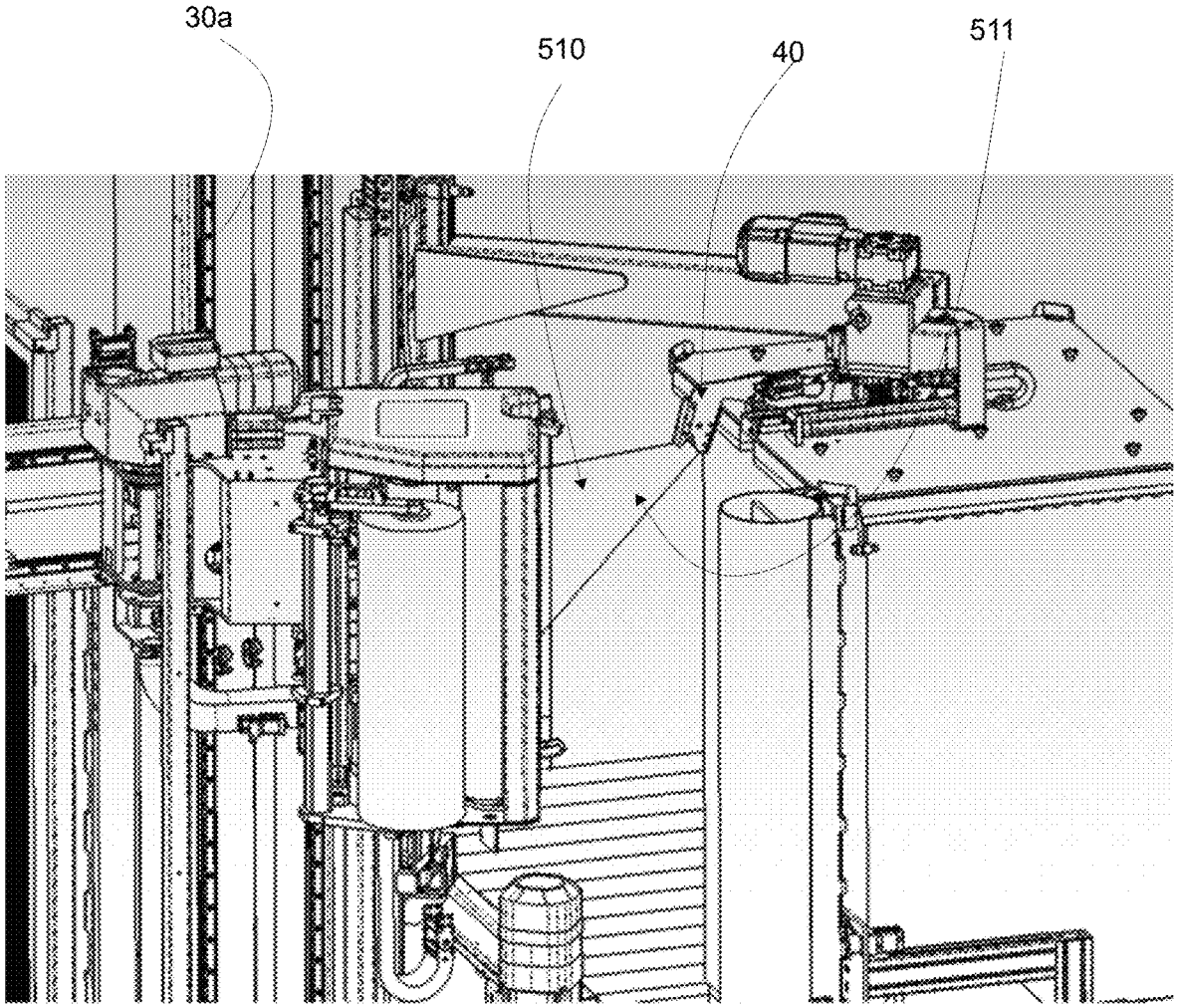
FIG. 3: illustrates an axonometric view of a wrapping machine in the operating position of starting wrapping.
Figure 4:
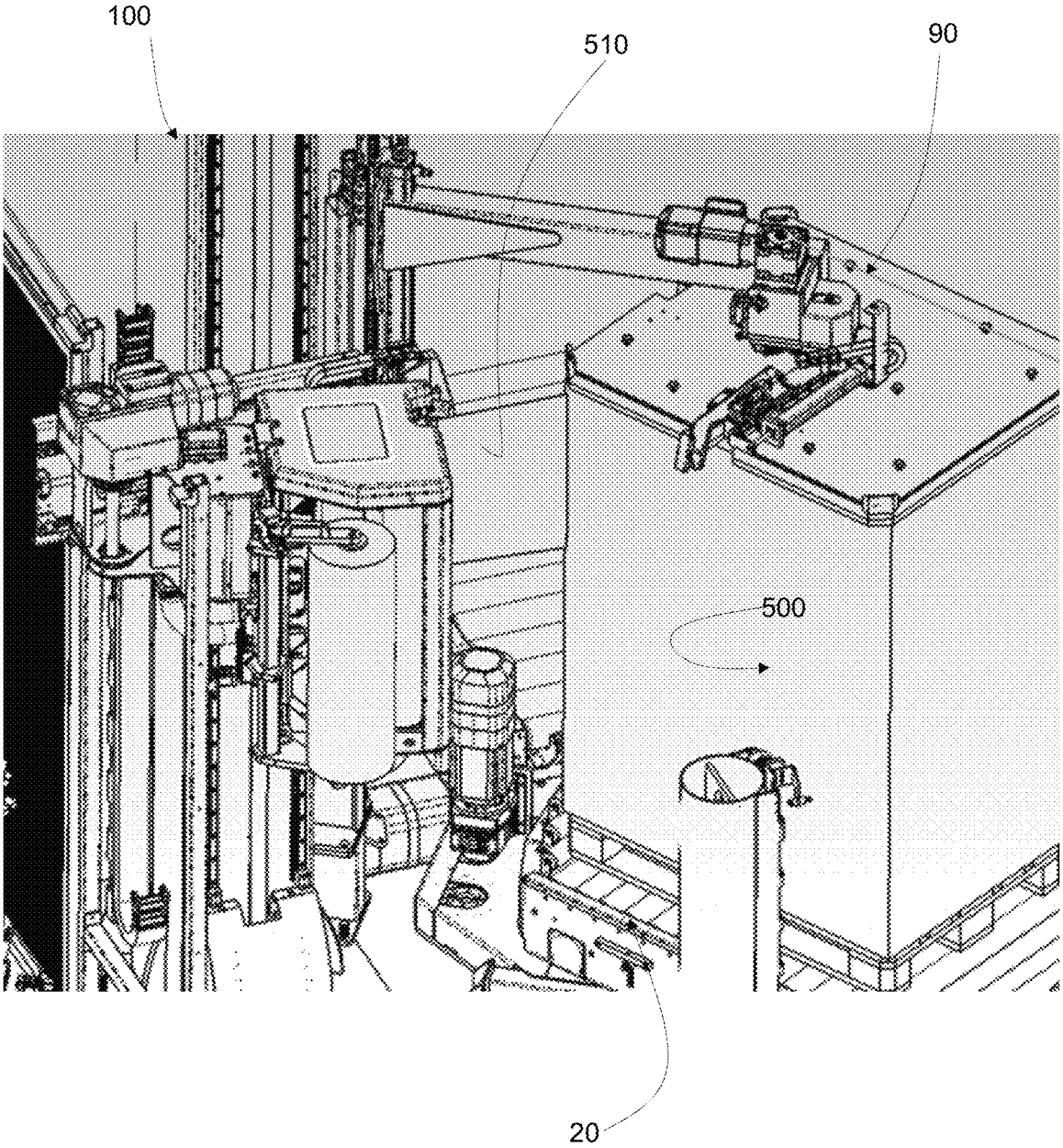
FIG. 4: illustrates an axonometric view of a wrapping machine in the wrapping operating position.
Figure 5:
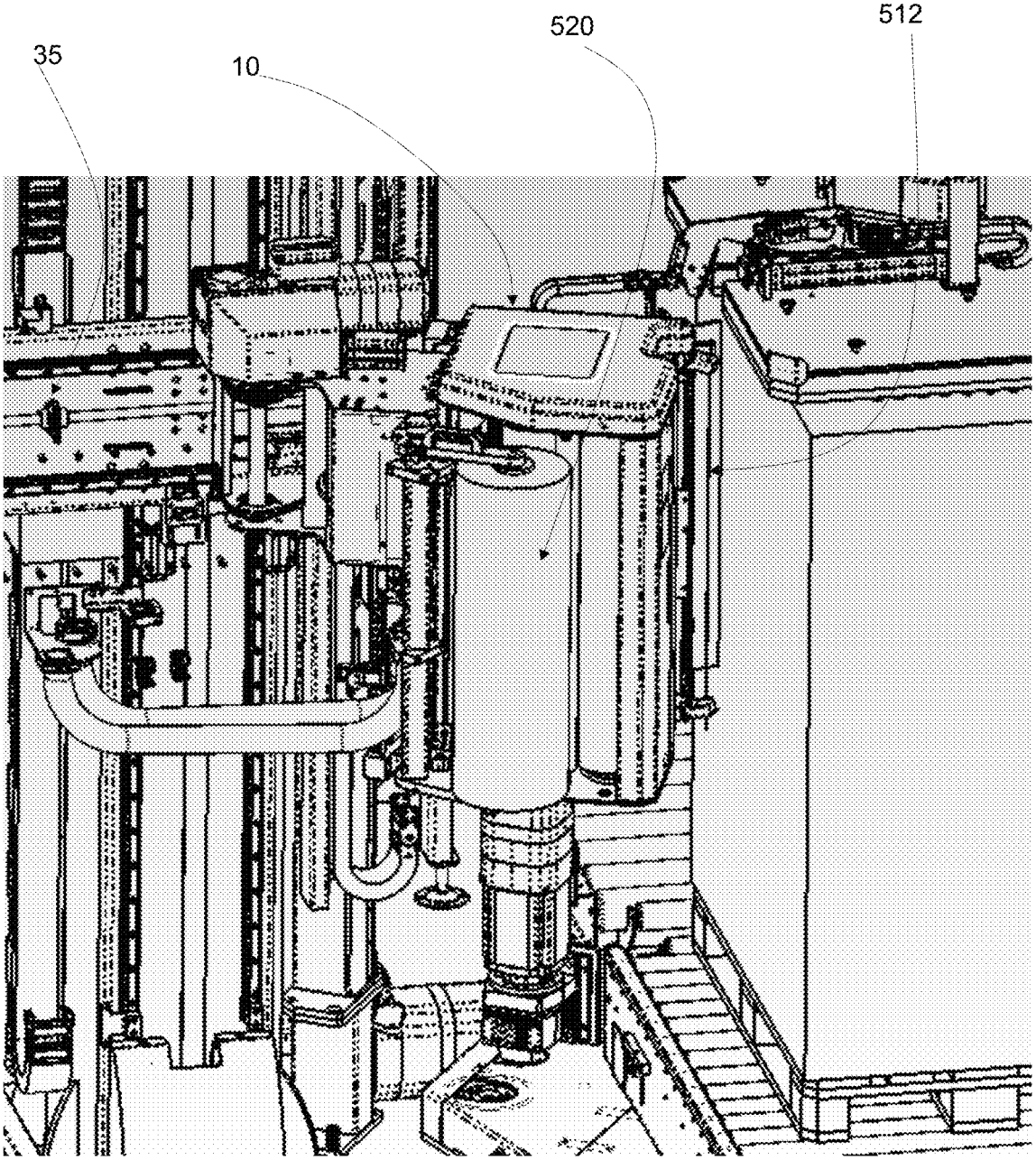
FIG. 5: illustrates an axonometric view of a wrapping machine in the operating position of cutting and welding the film.
Figure 6:
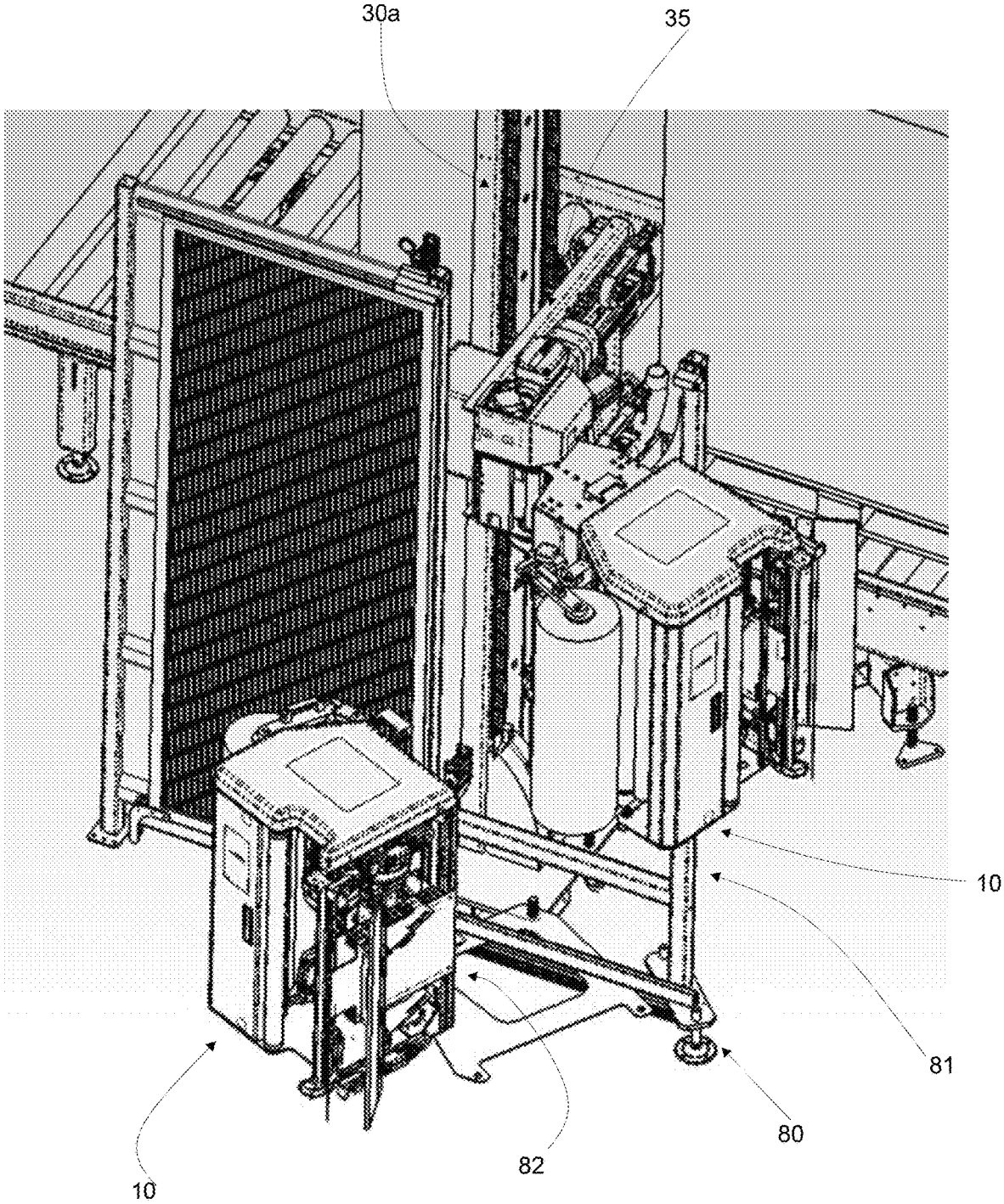
FIG. 6: illustrates an axonometric view of a wrapping machine in the winding-head change position.

With particular reference to FIG. 1, a wrapping machine 100 configured for wrapping a palletized load 500 is represented.

In particular, said palletized load 500, which we will also refer to in the following as simply the pallet 500, comprises a support pallet 501 on which a plurality of products are stacked.

The dimensions of said palletized load 500 may vary between various sizes such as 400×600, 800×600, 800×1200, 100×1200, 1420×1120, etc., which are generally the standard dimensions of a support pallet 501.

In particular, said palletized load 500 is wrapped by means of protective packaging material 510.

Said packaging material can be of different types, preferably a stretch film. The stretch film 510 is for example made of polyethylene.

Alternatively, protective packaging materials 510 such as mesh-formed materials, paper-type materials, etc., may also be used.

In the following, the protective packaging material 510 will also be simply called film 510 without thereby restricting the field of application of the invention.

Further, said machine 100 comprises support means 20 for a palletized load 500 configured to keep it and/or bring it into operating position for wrapping.

As represented in the figure, said support means may provide drive means for advancing the pallet 500 as far as to the wrapping position. Alternatively, they can simply be rests for the pallet 500 that can be positioned in the wrapping position by means of external means such as a forklift or a pallet truck or agv.

A preferred embodiment provides that said support means 20 are configured to put the palletized load 500 in rotation.

Preferably, said rotation takes place according to an axis of vertical X that substantially coincides with the axis of symmetry of the pallet 500 itself, subject to the positioning and conformation tolerances of said palletized load 500.

Said machine 100 comprises a winding head 10 for wrapping the palletized load 500 configured to support and unwind a coil 520 of film 510.

Said winding head 10 is further configured to cooperate with the support means 20.

In fact, during the rotation of the support means 20 and of the relative pallet 500 in position onto them, the winding head 10 allows to unwind the coil 520 to transfer the film 510 around the side surface 503 of the load 500.

Generally, the machine 100 comprises holding means 40 that hold a first flap 511 of said film 510 unwound from the coil 520 so that a said first flap 511 moves integral with the pallet 500 during the work cycle of the machine 100.

Said holding means 40 may be positioned at the base of the pallet 500, e.g. integrated into the support means 20; alternatively, as represented in the figures, they may be positioned at the top of the pallet 500, e.g. integrated into a presser 90, which stabilizes the palletized load 500 during wrapping.

Other solutions known to a person skilled in the art involving different configurations of the holding means 40 are to be considered within the scope of protection of the invention.

According to a preferred embodiment, said machine 100 comprises a lifting body 30 adapted to support and move the winding head 10, as represented in the figures.

In particular, said lifting body 30 comprises a bearing structure 31 that extends vertically.

Advantageously, said lifting body 30 comprises a shifting apparatus 35.

In particular, said shifting apparatus 35 is vertically movable along said bearing structure 31.

As represented in the figures, the shifting apparatus 35 is adapted to support and shift the winding head 10 in a horizontal direction.

Preferably, the shifting apparatus 35 is vertically movable along said bearing structure 31, during the rotation of the palletized load 500 to vertically shift the winding head 10 and wrap the palletized load 500 over a part or over its entire height.

In particular, the horizontal shift of the winding head 10 occurs by moving closer to/away from the support means 20 and/or from the palletized load 500.

Thus, thanks to this solution, the winding head 10 is not only configured to shift in a vertical direction along the bearing structure 31. In fact, said winding head 10 is not directly connected to the bearing structure 31, as is the case in the prior art.

In particular, between the winding head 10 and the bearing structure 31 the shifting apparatus 35 is preferably interposed.

The shifting apparatus 35 is therefore configured to shift along the bearing structure 31.

The winding head 10 is movably installed on said shifting apparatus 35.

Thus, the winding head 10 is vertically movable along the bearing structure 31 and horizontally along the shifting apparatus 35.

On the bearing structure 31 vertical guide and handling means **30*a*, that allow the vertical movement of the shifting apparatus 35**, are present.

We will not go into the details of said guide and handling means **30*a***, as they can be manufactured according to various solutions and comprise different types of components.

In the figure, a possible non-limiting embodiment is shown wherein the guide and vertical handling means **30*a* comprise belt-driven lifting means coupled with a gear motor placed at the base of the lifting body 30; a pair of linear guides installed on the bearing structure 31 is coupled with corresponding sliding carriages placed on the shifting apparatus 35**.

One embodiment, not shown in the figure, may provide to install the shifting presser 90 on the same guide means on which the shifting apparatus 35 moves. This allows to obtain a simple and cost-effective solution. On the other hand, the handling means are independent.

Figure 7:
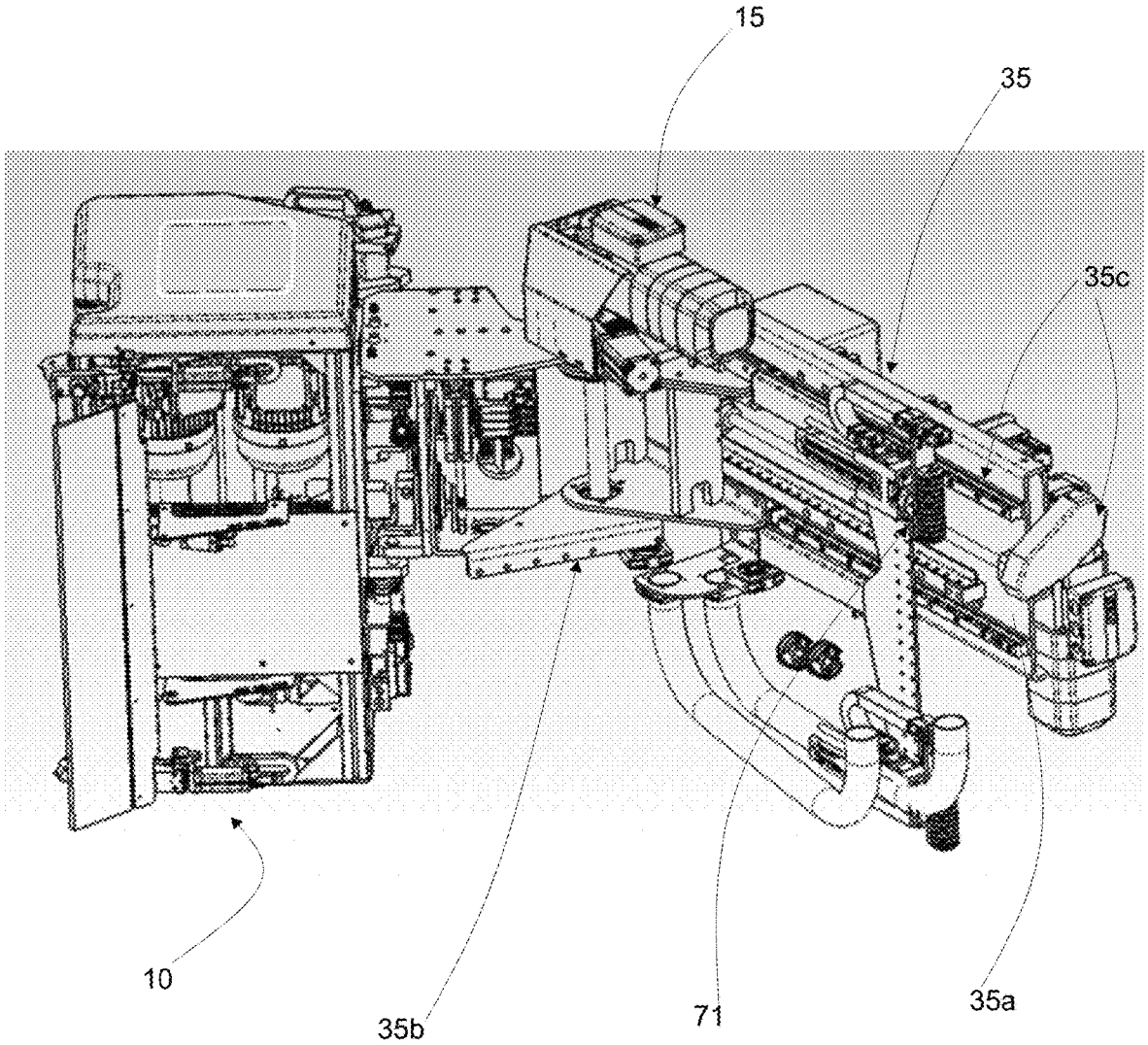
FIG. 7: illustrates an axonometric view of the shifting apparatus with the winding head.
Figure 8:
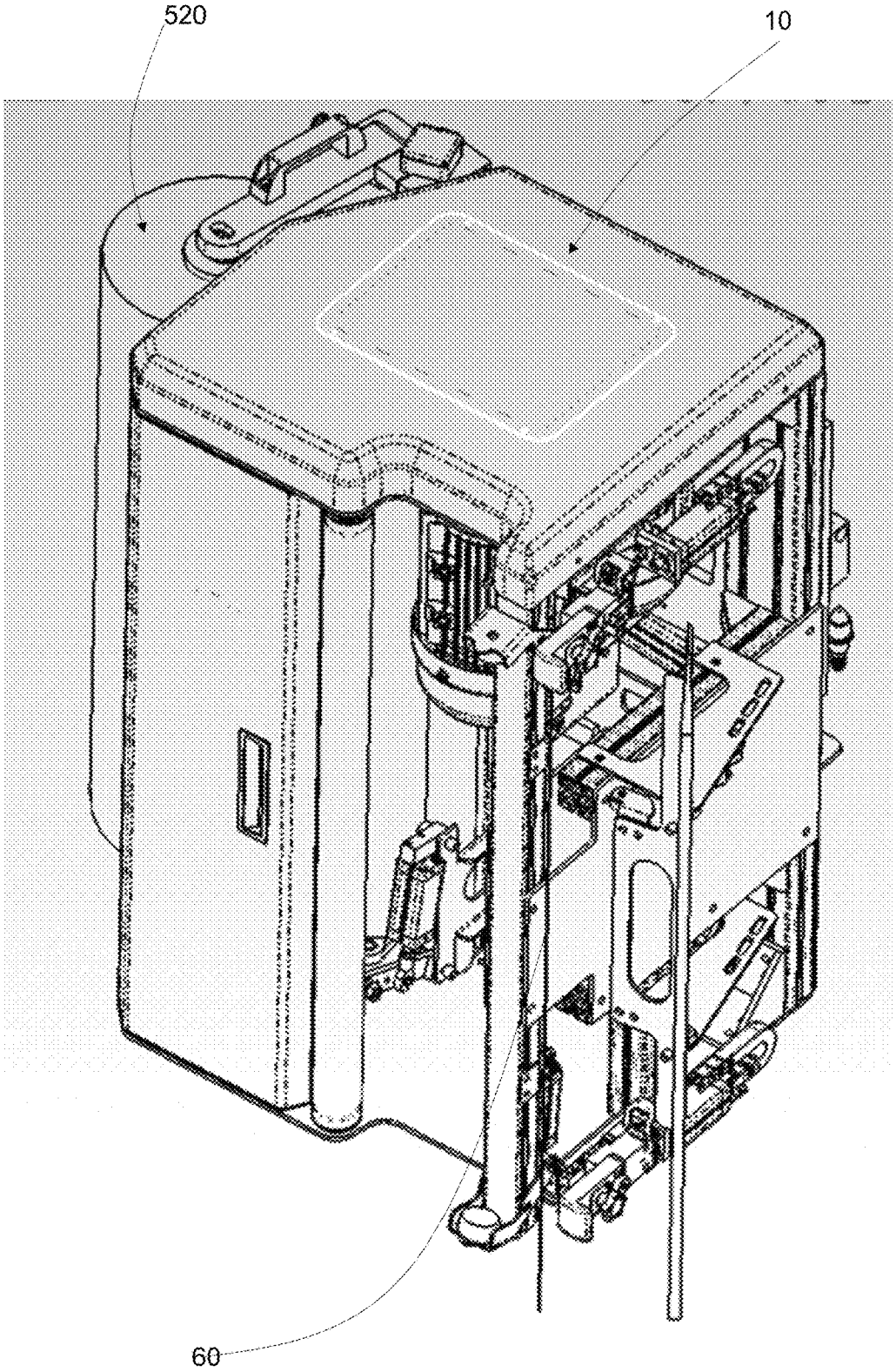
FIG. 8: illustrates an axonometric view of the winding head.
Figure 9:
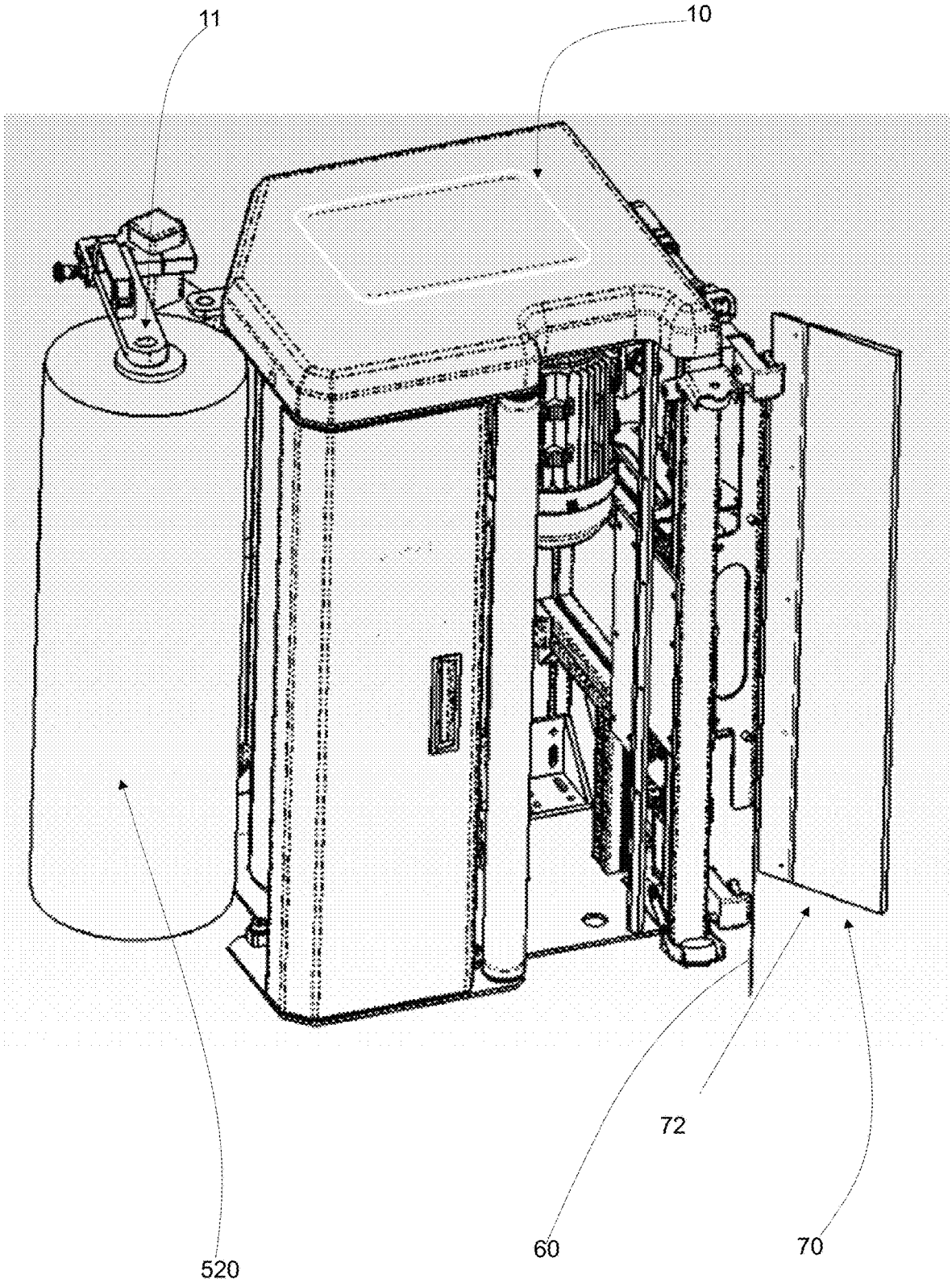
FIG. 9: illustrates a different axonometric view of the winding head.

In FIG. 7, the shifting apparatus comprises a beam **35*a*** that extends horizontally.

Said beam **35*a*** is preferably made of bent metal sheet.

Horizontal guide and handling means **35*c* are present on said beam 35**.

In the figures is a possible non-limiting embodiment is shown in which the shifting apparatus 35 comprises a carriage 35*b* interposed between the beam 35*a* and the winding head 10.

The winding head 10 is preferably removably installed on said carriage 35*b*.

In this case also, we will not go into the details of said horizontal guide and handling means 35*c*, as they can be manufactured according to various solutions and comprise different types of components.

For example, in FIG. 7, said horizontal guide and handling means 35*c* comprise a gear motor placed on the beam 35*a* coupled with belt drive means that rotate a screw/nut mechanically connected to the carriage 35*b*; a pair of linear guides installed on the beam 35*a* with corresponding sliding carriages placed on said carriage 35*b*.

A preferred operation of the machine 100 provides that the winding head 10, moving along the shifting apparatus 35, shifts in a horizontal direction to move to an operating wrapping-cycle start position.

In this position, the winding head 10 moves closer to the holding means 40 which take an initial flap 511 of film from the coil 520 and hold it during wrapping.

Preferably, the holding means 40 are configured to move closer to the winding head 10.

Thanks to the shift of the winding head 10, the time for taking the initial flap 511 of the film is reduced, as the holding means 40 do not have to perform the entire stroke to move closer to the winding head 10, but can perform a reduced stroke.

Furthermore, in the event that said holding means 40 are installed on the presser 90 as shown in the figures, the shift of said holding means 40 can only be activated when the pallet 500 has positioned itself in the wrapping zone and the presser 90 has descended to rest on top of the pallet 500.

This burdens on the cycle time of the machine 100.

By contrast, with the solution object of the invention, the winding head 10 can start shifting towards the holding means 40 before the pallet 500 has positioned itself in the wrapping area.

Thereby, the shifting time of the winding head 10 is overlapped on the positioning time of the palletized load 500 and therefore does not burden on the cycle time of the machine 100.

An embodiment variant could also provide to have stationary and not movable holding means 40; in this case the movement for taking the initial flap 511 of the film is carried out completely by the winding head 10.

Regarding the winding head 10, it may comprise a support element 11 configured to rotatably support the coil 520.

The winding head 10 may comprise means to pre-stretch the film 510.

We will not go into detail on all the components of the winding head 10, as they are generally known to a person skilled in the art.

We herein describe only a few components that may be present on said winding head 10 and that are important for highlighting the most advantageous aspects obtained by means of the solution subject matter of the invention.

According to an aspect of the invention, the winding head 10, comprises cutting means 60 and/or adhesion means 70.

In particular, the cutting means 60 are configured to cut the final flap 512 of the film.

Said cutting means 60 preferably comprise an incandescent edge.

Said cutting means 60 are preferably installed on the winding head 10 and are integral therewith.

Therefore, once the pallet 500 has been wrapped, the film 510 must be cut by separating it from the coil 520.

This operation occurs by bringing the winding head 10 closer to the palletized load 500 so that the cutting means 60 carry out the cut close to the pallet 500 so as not to have a final flap 512 that is too long.

Once said cut has been made, the adhesion means 70 can be activated.

In particular, the adhesion means 70 are configured to clamp the final film flap 512 making it integral with the wrapped palletized load 500.

Said adhesion means 70 can be installed on the winding head 10 and are integral thereto.

Alternatively, such adhesion means 70 may also be independent of the winding head 10 and be positioned in a station subsequent to the wrapping one.

According to an embodiment represented in the figures, the adhesion means 70 may comprise welding elements 71 and/or pressure elements 72.

The welding elements 71 can be of various types, such as glue or hot welding and of various types.

Said welding elements 71 aim at making the final flap 512 of the film adhere to the film 510 wrapping the wrapped palletized load 500, by heating a portion of said final flap 512 of film to generate a fusion with the underlying film 510 and to obtain a weld.

Generally, the welding elements 71 intervene when the pallet 500 is stationary.

FIG. 7 shows a possible embodiment wherein the welding elements 71 are installed directly on the carriage 35*b* and not on the winding head 10.

The pressure elements 72 can be combined with the welding elements 71 and act after them to complete the adhesion of the final flap 512 of the film so that no parts, that are not completely adhered to the film 510 of the wrapped pallet 500, are left free to move.

Said pressure elements 72 are configured to rest on the film 510 of the wrapped pallet 500 by exerting pressure on the final flap 512 of the film.

In fact, the final flap 512 of film, which is generally not pre-stretched, has a higher adhesive capacity than the pre-stretched film 510 wrapping the pallet 500.

A possible solution may also provide to exploit the adhesive effect of the final flap 512 of film, and thus only pressure elements 72 and not welding elements 71 may be provided on the winding head 10.

Said pressure elements 72 can be, for example, a brush, rubber pad, sponge, etc., i.e. an element capable of exerting a pressure on the load 500 without damaging it.

Generally, the pressure elements 72 intervene during the exit of the pallet 500 from the wrapping area by keeping the winding head 10 near the palletized load 500.

A further advantageous embodiment provides that the shifting apparatus 35 is configured to shift the winding head 10 in a direction away from the support means 20 to a position wherein the winding head 10 cooperates with the receiving means 80, adapted to carry out the change of the winding head 10.

This position allows the winding head 10 to be brought in an area that is also more accessible to the operator.

Said receiving means can be positioned 80 in said area.

Said receiving means 80 may comprise two stations, a first station 81 that is empty and ready to receive the head 10 to be disassembled from the machine 100 and a second station 82 comprising the head 10 to be installed on the machine 100. According to an advantageous embodiment, the head change can be performed automatically without stopping the machine 100.

This makes it possible to save time, so that the head-change time 10 affects as little as possible the cycle time of the machine 100.

This makes it easier to change the winding head 10, which can be carried out, for example, to reintegrate the exhausted coil 520.

The winding head 10, moving vertically and horizontally, is moved so as to fit into the first empty station 81.

Once the head 10 is inserted into the empty station 81, the automatic change provides to automatically release the head 10 from the carriage 35*b*.

The shifting apparatus 35 moves the carriage 35*b* towards the second station 82 to engage the new winding head 10 to the carriage 35*b*, connecting it automatically.

Once connected, the lifting body 30 lifts the shifting apparatus 35 and the head 10 to restart the wrapping cycle.

A preferred embodiment provides that the carriage 35*b* comprises rotation means 15, configured to rotate the winding head 10 around a vertical axis.

This rotation preferably takes place so as to move the winding head 10 away from the shifting apparatus 35.

This allows the head 10 to be brought to a position further away from the shifting apparatus 35 and thus freer for the insertion of the receiving means 80.

Said rotation may provide to rotate the winding head 10 by an angle of between 0 and preferably 270°, to move away from the shifting apparatus 35 and the bearing structure 31.

Said rotation means 15 can be made by means of, for example, an electric motor/gear motor, or a pneumatic piston, or any other solution known to a person skilled in the art.

A possible working cycle of the machine 100 is described hereinafter wherein the advantages, in terms of operation and cycle time, of the machine 100 subject of the invention are made clear.

In accordance with an object of the invention, said machine 100 further comprises a programmable control unit configured to implement the wrapping cycle in particular according to the process described below.

One aspect of the invention provides that the wrapping of the palletized load 500 by means of film 510, preferably takes place according to the following steps:

- supporting and/or moving the palletized load 500 resting on support means 20 and keeping it and/or shifting it into the operating position for wrapping,
- unwinding a first flap 511 of film from the coil 520,
- bringing said feed head 10 closer to said palletized load 500 preferably so that it cooperates with the holding means 40 to hold said first flap 511 of film integral with said palletized load 500,
- making said palletized load 500 rotate preferably by rotating the support means 20 so as to unwind the film 510 from the coil 520 by wrapping a side surface 503 of the palletized load 500.

Preferably while the palletized load 500 is brought to the operating position for wrapping, the feed head 10 shifts closer to said palletized load 500 to cooperate with the holding means 40.

This makes it possible to hide the time of approaching the head 10 with the time of entry of the pallet 500 so that it does not add to the cycle time of the machine 100.

Preferably before rotating the support means 20 and the pallet 500, the winding head 10 retracts preferably to get out of the way of said support means 20 during their rotation.

Said method also provides to wrap the palletized loads 500 having different dimensions by positioning said feed head 10 at the distance that is most suitable for the dimensions and shape of said palletized load 500.

The presence of the shifting apparatus 35 makes it possible to optimize the distance between the feed head 10 and the rotating palletized load 500.

This optimized distance makes it possible to improve the wrapping quality and speeds up the wrapping cycle.

It also allows to optimize the cutting and adhesion step by bringing the winding head 10 into contact with palletized loads with very different dimensions, for example from 400×600, up to 1420×1120.

Said wrapping process provides, while rotating the palletized load 500, to vertically move the feed head 10 to wrap the palletized load 500 over a part or over its entire height.

Unlike known gantry or column machines, once the palletized load 500 has been wrapped, it is not necessary to perform a cycle to bring the palletized load 500 closer to the coil 520.

In fact, in the prior art, it is necessary to rotate the support means 20 so as to advance the load 500 towards the coil 520 and once the operation of cutting and/or adhesion of the film 510 has been carried out, it is necessary to move the load 500 away by returning it to its previous position and rotate the support means 20 to allow the wrapped load 500 to be evacuated.

However, according to the invention, once the wrapping of the pallet 500 is complete, the support means 20 stop and the winding head 10 moves closer the load to cut the film 510.

This makes it possible to perform the cut directly on the side opposite to the running side of the pallet 500.

With the winding head 10 near the pallet 500, the adhesion of the final flap 512 to the film 510 of the wrapped pallet 500 can also be performed.

Said adhesion can take place at the same time as the pallet 500 leaves the wrapping area.

This, too, makes it possible to hide the adhesion time with the exit time of the pallet 500, without burdening on the cycle time of the machine 100.

The working method described above can also be performed using a machine wherein the winding head 10 is installed on an anthropomorphic robot.

The machine 100 described above is therefore able to move into the same working positions as an anthropomorphic robot and perform the same operating cycle.

Thanks to this invention, it is also possible to use the same work recipes as those used on an anthropomorphic robot, allowing the standardization of programs for different types of pallets or films.

Therefore, thanks to said machine 100, as it is possible to vertically lift the winding head 10 and shift it horizontally, a high degree of positioning flexibility is achieved, allowing to reach working positions similar to those of an anthropomorphic robot.

This simplifies programming, in particular by making it possible to reuse programming recipes which can be set on several types of machines, even those with robots.

It in any case is intended for that described above to be given by way of non-limiting example; therefore, possible detail variants that may be required for technical and/or functional reasons are considered from now as to fall within the same protective scope defined by the claims below.

The invention claimed is:

1. Wrapping machine for wrapping a palletized load by means of a stretch film protective packaging material, said palletized load comprising a support pallet on which a plurality of products are stacked, said machine comprising:

support means of the palletized load configured to hold the palletized load and/or shift the palletized load into an operating position for wrapping and rotating said palletized load according to a vertical axis of symmetry, a winding head configured to support and unwind a coil of said stretch film, a lifting body comprising a bearing structure that extends vertically, wherein said lifting body comprises a shifting apparatus vertically movable along said bearing structure and adapted to support and shift in a horizontal direction the winding head, when moving closer to or away from the support means and/or the palletized load, wherein the shifting apparatus comprises a beam and a carriage, with a pair of linear guides installed on the beam and corresponding sliding carriages on said shifting apparatus carriage, which enable extension of the shifting apparatus carriage in a horizontal direction, the shifting apparatus carriage interposed between the beam and the winding head, and wherein the shifting apparatus carriage further comprises rotation means, configured to rotate said winding head about a vertical axis and away from the shifting apparatus and/or the bearing structure, to carry out its positioning on the receiving means.

2. The machine according to claim 1, wherein the shifting apparatus is vertically movable along said bearing structure, for vertically shifting the winding head and wrapping the palletized load over a part or over an entire height thereof, during the rotation of said palletized load.

3. The machine according to claim 1, wherein the winding head is removably installed on the carriage.

4. The machine according to claim 1, wherein the shifting apparatus is configured to shift the winding head in a direction away from the support means to a position wherein the winding head cooperates with the receiving means adapted to carry out a change of the winding head.

5. The machine according to claim 1, further comprising holding means configured to take from the coil an initial flap of film and hold the initial flap during wrapping, said holding means being positioned at the top or at the base of the palletized load to be wrapped.

6. The machine according to claim 5, wherein the shifting apparatus shifts the winding head in a horizontal direction, to bring the winding head closer to the holding means.

7. The machine according to claim 5, wherein the holding means are configured to shift toward the winding head.

8. The machine according to claim 1, wherein the winding head, comprises cutting means and/or adhesion means to cut the final flap of film and clamp the final flap of film by making the final flap of film integral with the wrapped palletized load.

9. The machine according to claim 8, wherein the adhesion means comprise welding elements and/or pressure elements.

* * * * *